US009709344B2

(12) United States Patent
Brümmer et al.

(10) Patent No.: US 9,709,344 B2
(45) Date of Patent: Jul. 18, 2017

(54) HEAT EXCHANGER

(71) Applicant: Behr GmbH & Co. KG, Stuttgart (DE)

(72) Inventors: Richard Brümmer, Stuttgart (DE); Gunther Hentschel, Uhingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 296 days.

(21) Appl. No.: 14/043,990

(22) Filed: Oct. 2, 2013

(65) Prior Publication Data

US 2014/0096937 A1 Apr. 10, 2014

(30) Foreign Application Priority Data

Oct. 2, 2012 (DE) ..... 10 2012 218 069

(51) Int. Cl.
*G05D 15/00* (2006.01)
*G05D 16/00* (2006.01)
(Continued)

(52) U.S. Cl.
CPC ..... *F28F 9/0209* (2013.01); *F01P 7/165* (2013.01); *F28D 1/05375* (2013.01); *F28F 1/12* (2013.01); *F28F 27/02* (2013.01); *F28F 2250/06* (2013.01)

(58) Field of Classification Search
CPC ..... F28D 1/047; F28D 1/0443; F28D 15/06; F24F 1/025
(Continued)

(56) References Cited

U.S. PATENT DOCUMENTS 1,416,945 A * 5/1922 Chardard ..... F28D 1/047 165/151
2,071,026 A * 2/1937 Crosley, Jr. ..... F24F 1/025 165/115
(Continued)

FOREIGN PATENT DOCUMENTS

CN 101479554 A 7/2009
DE 42 32 366 A1 3/1994
(Continued)

OTHER PUBLICATIONS

German Search Report, Application No. DE 10 2012 218 069.9, Sep. 4, 2013, 5 pgs.
(Continued)

*Primary Examiner* — Ljiljana Ciric
(74) *Attorney, Agent, or Firm* — Paul D. Strain, Esq.; Strain & Strain PLLC

(57) ABSTRACT

A coolant cooler has a cooling block formed by tubes arranged parallel to one another. The tubes form multiple first flow ducts through which a first fluid can flow. In regions between the tubes multiple second flow ducts are formed through which a second fluid can flow. The coolant cooler includes a first collecting box on which a first fluid inlet is arranged and a second collecting box on which a first fluid outlet is arranged. The first flow ducts are in fluid communication with a first cooling circuit via the first fluid inlet, the first fluid outlet, and the collecting boxes. The first or second collecting box has a second fluid inlet and a second fluid outlet such that the second fluid inlet, the respective collecting box, and the second fluid outlet are in fluid communication with a second cooling circuit.

10 Claims, 5 Drawing Sheets

(51) Int. Cl.

| | |
|---|---|
| ***G05D 23/00*** | (2006.01) |
| ***F28F 9/02*** | (2006.01) |
| ***F28F 1/12*** | (2006.01) |
| ***F28F 27/02*** | (2006.01) |
| ***F28D 1/053*** | (2006.01) |
| ***F01P 7/16*** | (2006.01) |

(58) Field of Classification Search
USPC ..... 165/279, 296, 297, 151
See application file for complete search history.

(56) References Cited

U.S. PATENT DOCUMENTS

| | | | | |
|---|---|---|---|---|
| 2,179,702 | A * | 11/1939 | Saunders | F28D 1/0426 165/140 |
| 3,601,878 | A * | 8/1971 | Karmazin | B21D 53/08 165/149 |
| 3,606,282 | A * | 9/1971 | Stookey | F28F 27/00 165/279 |
| 3,776,305 | A * | 12/1973 | Simmons | F28D 15/06 165/104.14 |
| 3,863,708 | A * | 2/1975 | Grimes | B01D 51/10 165/134.1 |
| 4,156,408 | A * | 5/1979 | Protze | B60K 11/04 123/41.09 |
| 4,319,630 | A * | 3/1982 | Hronek | F28D 7/0008 165/140 |
| 4,483,392 | A * | 11/1984 | Korsmo | F28D 7/08 165/122 |
| 4,690,209 | A * | 9/1987 | Martin | F25B 39/02 165/135 |
| 5,526,873 | A | 6/1996 | Marsais et al. | |
| 7,506,683 | B2 * | 3/2009 | Hu | F28D 1/0443 165/140 |
| 2004/0050543 | A1 | 3/2004 | Kim et al. | |
| 2005/0257921 | A1 | 11/2005 | Hu | |
| 2005/0269062 | A1 | 12/2005 | Guerrero et al. | |
| 2006/0254538 | A1 | 11/2006 | Hassdenteufel et al. | |
| 2008/0047687 | A1 | 2/2008 | Leitch et al. | |
| 2011/0073291 | A1 | 3/2011 | Hu | |
| 2014/0096936 | A1 | 4/2014 | Brümmer et al. | |
| 2016/0178291 | A1 | 6/2016 | Brümmer et al. | |

FOREIGN PATENT DOCUMENTS

| | | | |
|---|---|---|---|
| DE | 195 18 323 | A1 | 11/1996 |
| DE | 100 45 905 | A1 | 3/2002 |
| DE | 101 02 640 | A1 | 7/2002 |
| DE | 10 2005 047 840 | A1 | 6/2006 |
| DE | 602 16 049 | T2 | 7/2007 |
| DE | 10 2006 036 742 | A1 | 2/2008 |
| DE | 10 2006 061 440 | A1 | 6/2008 |
| DE | 10 2010 049 094 | A1 | 6/2011 |
| DE | 10 2011 083 345 | A1 | 4/2012 |
| FR | 2 682 160 | A | 4/1993 |
| JP | 6-81648 | A | 3/1994 |
| WO | WO 2004/063543 | A2 | 7/2004 |
| WO | WO 2008/074953 | A1 | 6/2008 |
| WO | WO 2010/008960 | A2 | 1/2010 |
| WO | WO 2011/134786 | A1 | 11/2011 |

OTHER PUBLICATIONS

German Search Report, Appl. No. 10 2013 220 031.5, Feb. 7, 2014, 5 pgs.
German Search Report, Appl. No. 10 2013 220 039.0, Mar. 5, 2014, 5 pgs.
Brümmer, U.S. PTO Notice of Allowance, U.S. Appl. No. 14/043,962, Jul. 18, 2016, 11 pgs.
Brümmer, U.S. PTO Office Action, U.S. Appl. No. 14/043,962, Apr. 5, 2016, 13 pgs.
Brümmer, U.S. PTO Office Action, U.S. Appl. No. 14/043,962, Dec. 29, 2016, 10 pgs.
Brümmer, U.S. PTO Notice of Allowance, U.S. Appl. No. 14/043,962, Apr. 10, 2017, 8 pgs.

* cited by examiner

HEAT EXCHANGER

CROSS-REFERENCE TO RELATED PATENT APPLICATIONS

This application is based upon and claims the benefit of priority from prior German Patent Application No. 10 2012 218 069.9, filed Oct. 2, 2012, the entire contents of which are incorporated herein by reference in their entirety.

TECHNICAL FIELD

The invention relates to a heat exchanger, in particular a coolant cooler, for a motor vehicle, having at least one block which is formed by tubes arranged parallel to one another and by fins arranged between the tubes, wherein the tubes form multiple first flow ducts through which a first fluid can flow, wherein the regions between the tubes form multiple second flow ducts through which a second fluid can flow around the tubes, having a first collecting box on which a first fluid port is arranged, having a second collecting box on which a second fluid port is arranged, wherein the first flow ducts are in fluid communication with a first cooling circuit via the first fluid port, the second fluid port and the collecting boxes.

PRIOR ART

In engine coolant circuits of motor vehicles there circulates a coolant which cools the components integrated into the circuit and thus keeps these in the most optimum possible temperature window for their operation.

In order, in the case of low engine temperatures, to ensure a fast warm-up of the engine to an optimum operating temperature, the coolant circuits often have a thermostat which is switched as a function of the temperature of the coolant. By means of said thermostat, parts of the coolant circuit can be opened up or closed.

Some components, such as for example waste heat recovery condensers (condensers for the utilization of waste heat), require as low a temperature as possible for optimum operation. The component is therefore advantageously permanently cooled by a coolant.

Operating states however exist in which the coolant circuit is influenced by the thermostat such that the coolant flow through the main coolant cooler is greatly reduced or even stopped. There is then no longer a flow, or at least no longer an adequate flow, through the components that require cooling, said components often being integrated into the coolant circuit directly downstream of the main coolant cooler.

In the prior art, solutions are known in which, for example, there is integrated an additional coolant cooler which is traversed by flow independently of the main coolant cooler. For this purpose, the existing coolant circuit is expanded to include extra lines and an additional coolant cooler. The additional elements result in costs being incurred, and additional installation space is required.

Solutions are also known in which, via a bypass, coolant is branched off from the feed line of the main coolant cooler and, after flowing through the component to be cooled, is supplied back to the coolant circuit. Here, the cooling action of the main coolant cooler is not utilized because the coolant is conducted past the main coolant cooler. To be able to activate the bypass according to the situation, additional valves and/or thermostats are required. As a result of these additional elements, it is likewise the case that additional costs are incurred and additional installation space is required.

A disadvantage of the solutions according to the prior art is that individual components that require constant cooling by means of a coolant are either not sufficiently cooled by coolant, or the cooling of the components is realized only by means of additional coolant coolers and/or bypass branches.

Presentation of the Invention, Problem, Solution, Advantages

The problem addressed by the present invention is therefore that of providing a heat exchanger which creates a simple and inexpensive facility for cooling components in the coolant circuit by means of a coolant, in particular when the coolant flow through the main coolant cooler is greatly reduced or stopped. Said problem also consists in providing an arrangement of a heat exchanger of said type in a motor vehicle.

The problem addressed by the present invention is solved by means of a heat exchanger having the features of claim 1.

An exemplary embodiment of the invention relates to a heat exchanger, in particular a coolant cooler, for a motor vehicle, having at least one block which is formed by tubes arranged parallel to one another and by fins arranged between the tubes, wherein the tubes form multiple first flow ducts through which a first fluid can flow, wherein the regions between the tubes form multiple second flow ducts through which a second fluid can flow around the tubes, having a first collecting box on which a first fluid port is arranged, having a second collecting box on which a second fluid port is arranged, wherein the first flow ducts are in fluid communication with a first cooling circuit via the first fluid port, the second fluid port and the collecting boxes, wherein the first collecting box or the second collecting box has a third fluid port, wherein the third fluid port, the respective collecting box and the second fluid port of the respective collecting box are in fluid communication with a second cooling circuit.

Here, depending on the predefined throughflow direction, the fluid ports may be both fluid inlets and fluid outlets.

Here, the heat exchanger may for example be a heat exchanger through which flow passes vertically or a heat exchanger through which flow passes horizontally. The heat exchanger is in fluid communication, via the first fluid port and the second fluid port, with a first cooling circuit. Here, said first cooling circuit may for example refer to the main cooling circuit of a vehicle, which generally runs through the internal combustion engine. The first fluid flows through said first cooling circuit.

The heat exchanger is in fluid communication, via a further fluid port, with a second cooling circuit. Here, the transfer of the fluid from the first cooling circuit into the second cooling circuit or from the second cooling circuit into the first cooling circuit takes place via a connecting point arranged preferably outside the heat exchanger between the cooling circuits. The second cooling circuit serves for cooling a component, for example a waste heat recovery condenser.

The first flow ducts are advantageously formed from flat tubes. A flat tube is composed substantially of two opposite large flat side surfaces which are connected to one another via two narrow sides. The plane of the flow ducts thus refers to a plane running parallel to the large flat side surfaces of the flat tubes.

Here, in one preferred exemplary embodiment, the block of the heat exchanger is composed of a multiplicity of flat tubes which are arranged parallel to one another and which form the first flow ducts. The second flow ducts are formed between said flat tubes. In these there may advantageously be arranged fins which can promote the exchange of heat.

The construction of the heat exchanger with at least one block of flat tubes and fins arranged in between constitutes a construction as a tube-fin heat exchanger. This is particularly advantageous because a large number of commonly used heat exchangers are of this type of construction. Such heat exchangers are correspondingly inexpensive and are available in a wide variety of dimensions.

In a further advantageous embodiment, it may be provided that the first fluid port is arranged on one of the two end regions of the first collecting box and that the second fluid port is arranged in the central region of the second collecting box.

By means of an arrangement of the first fluid port on one edge region of a collecting box and the arrangement of the second fluid port in the central region of the other collecting box, a homogenization of the fluid distribution within the heat exchanger is realized. This leads to improved efficiency of the heat exchanger.

It is also advantageous for the first fluid port, the second fluid port and the third fluid port to be arranged in a direction perpendicular to the plane of the flow ducts or flat tubes.

The arrangement of the fluid ports in a direction perpendicular to the plane of the flow ducts or flat tubes is particularly advantageous because all of the fluid ports are arranged on a common outer side of the heat exchanger. This promotes simple manufacturing of the heat exchanger.

The plane of the flow ducts or of the flat tubes refers to the plane formed by the flow ducts or by the flat tubes. This is for example the common plane of the central axes of the flow ducts or of the flat tubes.

It is also preferable if, in the collecting box which has two fluid ports, the heat exchanger has a means for reducing and/or preventing a fluid flow between the two fluid ports.

As a result of the reduction of the fluid flow between the two fluid ports of a collecting box, a flow short circuit can be prevented. Such a flow short circuit would arise if the fluid within the collecting box were to flow directly from one fluid port to the other fluid port without flowing through the heat exchanger itself. By greatly reducing or completely preventing said fluid flow, it is possible to realize increased cooling of the fluid in the heat exchanger, which leads to more intense cooling of the component to be cooled.

It is also advantageous if the means for reducing and/or preventing a fluid flow between the two fluid ports of the respective collecting box is a flap or a valve or a partition.

It may also be advantageous for the collecting box that has the two fluid ports to have a means for increasing the pressure loss, which means divides the collecting box, in a direction perpendicular to the plane of the flow ducts or flat tubes, into a left-hand region and a right-hand region.

A means for increasing the pressure loss in the collecting box that has the two fluid ports may likewise be conducive to the fluid flow through the second cooling circuit.

A partition, for example, may be used as a means for increasing the pressure loss. Said partition may extend, parallel to the plane of the flow ducts or of the flat tubes, through the entire collecting box or only through part of the collecting box. In the extreme case, the partition, if arranged in a projection of the area of the opening of a fluid port, could also project out through the respective fluid port and even extend as far as into the coolant line.

It is also preferable if, by way of the means for reducing and/or preventing a fluid flow between the two fluid ports of the respective collecting box, the pressure loss in the respective collecting box between the two fluid ports of the collecting box can be varied as a function of a pressure difference between the third fluid port and the respective fluid port of the other collecting box or as a function of the fluid temperature in the second cooling circuit.

It is also advantageous if the second cooling circuit is formed between the second fluid port and the third fluid port. As a result of an arrangement of the second cooling circuit between the second fluid port and the third fluid port, it is possible to realize an advantageous flow through the heat exchanger and advantageous guidance of the fluid.

It is also expedient if the heat exchanger is of multi-part construction, wherein each subsection of the heat exchanger is in fluid communication with a first collecting box and also with a second collecting box, wherein each subsection of the heat exchanger has two fluid ports.

Here, the multi-part design may be realized in particular through the use of two separate heat exchanger blocks. As an alternative to this, a separation into subsections may also be realized by virtue of in each case one partition being inserted into the collecting boxes, which partition divides the respective collecting box, and thus the flat tubes connected to the collecting box, into two subsections. By means of such a division, it is advantageously possible to realize an adaptation of the cooling power for the first cooling circuit and for the second cooling circuit.

It is also advantageous for the means for reducing and/or preventing a fluid flow to be arranged within the second collecting box between the second and third fluid ports.

It is also preferable for at least one of the fluid ports to be configured as a fluid inlet connector and/or for at least one of the fluid ports to be configured as a fluid outlet connector.

The configuration of one fluid port as a fluid inlet connector and/or the configuration of one fluid port as a fluid outlet connector is particularly advantageous because fluid lines can be connected directly to said connectors, which facilitates the connection of the heat exchanger into a cooling circuit.

The object regarding the arrangement of the heat exchanger in a motor vehicle is achieved by means of an arrangement having the features of claim 8, according to which it is advantageous if the heat exchanger is arranged in a motor vehicle and a component to be cooled is integrated into the second cooling circuit, or a component to be cooled and a fluid pump are integrated into the second cooling circuit.

It is possible for the second cooling circuit to be operated with a dedicated fluid pump or without a dedicated fluid pump. A dedicated fluid pump offers the advantage that the fluid in the heat exchanger can be actively circulated. This is advantageous in particular if the convection flow that arises in the heat exchanger owing to the different temperatures of the fluid is not sufficient.

By means of a fluid pump, the circulation in the heat exchanger can be increased, whereby the cooling action is also increased. The fluid pump is advantageous in particular when the fluid flow through the heat exchanger along the first cooling circuit has been shut off or greatly reduced.

By contrast, a second cooling circuit without an additional fluid pump may be advantageous because, owing to the omission of the fluid pump, the costs are lower and less installation space is required.

It is also advantageous if, in the second cooling circuit, there is arranged a thermostat valve for regulating and/or controlling the fluid flow through the component to be cooled.

Furthermore, it is preferable if the second cooling circuit has a bypass duct by which fluid communication can be established between the two fluid ports of one collecting box or fluid communication can be established between in each case one fluid port of the first collecting box and one fluid port of the second collecting box.

By means of a bypass duct, the flow through the cooling circuits and/or through the heat exchanger can be adapted to requirements with even greater flexibility. This permits altogether greater flexibility of the overall system.

It is also advantageous for the first cooling circuit to be in fluid communication with the second cooling circuit via a connecting point outside the heat exchanger.

The provision of a connecting point outside the heat exchanger is particularly advantageous because an easy adaptation of the guidance of the fluid can be achieved in this way. No structural modifications to the heat exchanger itself need to be provided for this purpose.

Advantageous refinements of the present invention are described in the subclaims and in the following description of the figures.

BRIEF DESCRIPTION OF THE DRAWINGS

Below, the invention will be explained in detail on the basis of an exemplary embodiment and with reference to the drawings, in which.

PREFERRED EMBODIMENT OF THE INVENTION

Figure 1:
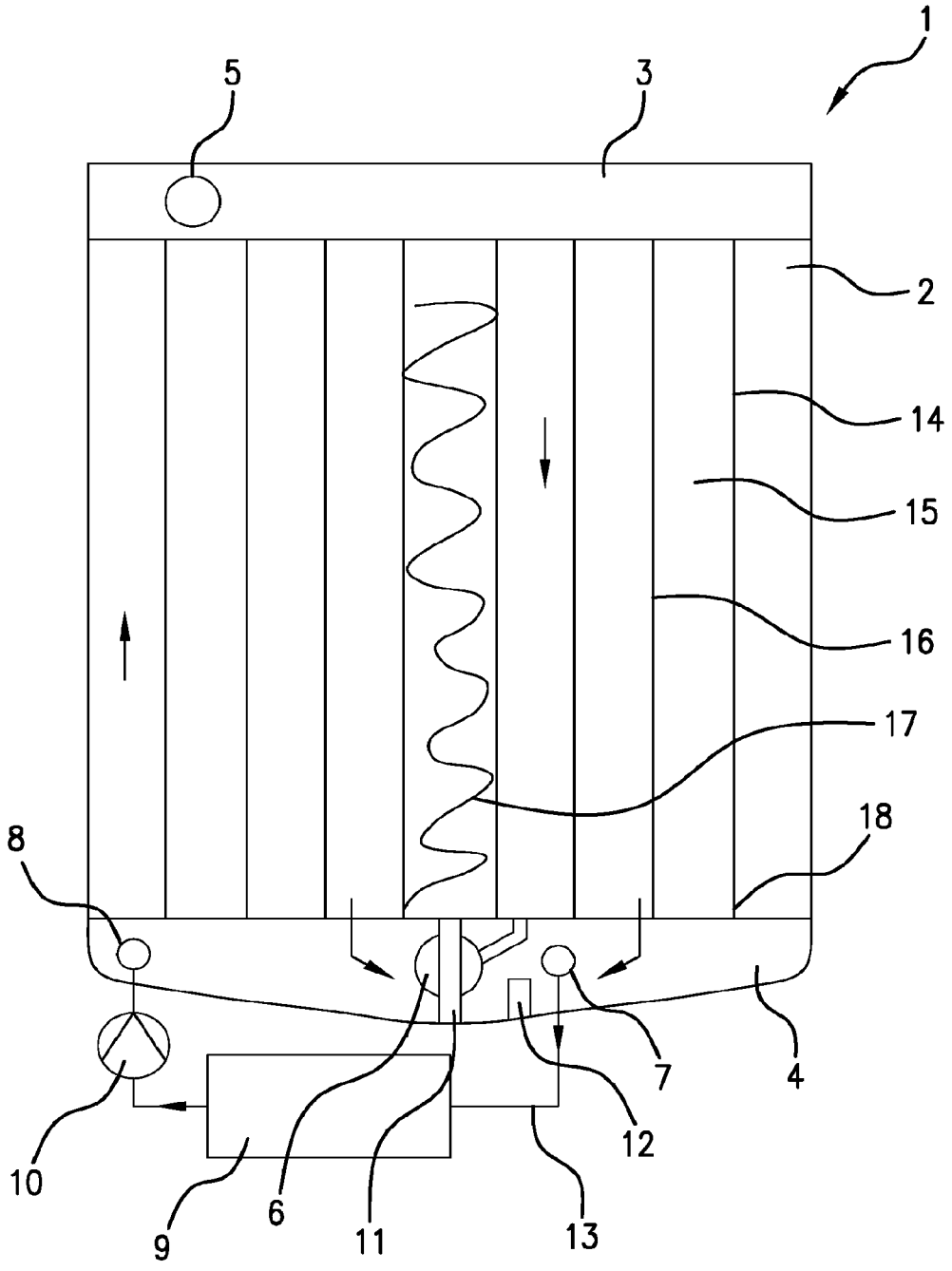
FIG. 1 shows a schematic view of a heat exchanger with a flap indicated and with a partition in one of the collecting boxes.

FIG. 1 shows a schematic view of a heat exchanger 1. The heat exchanger 1 is of a conventional type of construction. In FIG. 1, the fluid ports that are provided are denoted as fluid inlets and fluid outlets in accordance with a predefined throughflow direction.

The heat exchanger 1 is composed substantially of a block 2 which is composed of a multiplicity of flat tubes 16 arranged parallel to one another. Arranged between said flat tubes 16 are fins 17 which improve the exchange of heat. The flat tubes 16 are received, by way of their end regions 18, in collecting boxes 3, 4 and are in fluid communication with the latter.

Here, the flat tubes 16 form first flow ducts 14 flows around the first flow ducts 14, which second fluid can flow through the second flow ducts 15.

The heat exchanger 1 is integrated into a cooling circuit which is not shown in FIG. 1. A first fluid is supplied to the heat exchanger 1 via the first fluid inlet 5, which first fluid flows through the heat exchanger 1. In the process, the fluid is cooled. The first fluid inlet 5 is arranged in the upper collecting box 3. After the fluid flows in through the first fluid inlet 5, the fluid distributes in the collecting box 3 over the entire width of the heat exchanger 1. The fluid subsequently flows downward to the second collecting box 4 along the flat tubes 16, indicated in FIG. 1, of the block 2.

The collecting box 4 has a first fluid outlet 6. Said first fluid outlet 6 is positioned centrally in the collecting box 4. The fluid that flows along the block 2 from the collecting box 3 into the collecting box 4 is guided into the central region of the collecting box 4 and flows out of the heat exchanger 1 through the first fluid outlet 6.

The first cooling circuit, which constitutes the main flow through the heat exchanger 1, may in certain operating situations be controlled such that the heat exchanger 1 is no longer actively traversed by flow. The fluid within the heat exchanger 1 is then substantially static in the interior of the heat exchanger 1 or flows through the heat exchanger 1 at a flow speed which is low in relation to normal operation.

The second collecting box 4 of the heat exchanger 1 has a second fluid outlet 7 and a second fluid inlet 8. Via said second fluid inlet and fluid outlet 7, 8, the heat exchanger 1 is in fluid communication with a second cooling circuit 13.

The second cooling circuit 13 serves for the cooling of a component 9. In addition to the second cooling circuit 13 illustrated in FIG. 1, which has only one component 9 to be cooled, it is also possible for a cooling circuit to be provided which has a multiplicity of components 9 to be cooled.

The second fluid outlet 7 is arranged in the right-hand half of the collecting box 4. The second fluid inlet 8 is arranged at the left-hand end region of the collecting box 4. The first fluid outlet 6 is arranged between the second fluid outlet 7 and the second fluid inlet 8.

When the heat exchanger 1 is traversed by flow through the first cooling circuit in the usual way, the fluid situated in the heat exchanger 1 is likewise caused to flow through the second fluid outlet 7 into the second cooling circuit 13 and from there through the second fluid inlet 8 back into the collecting box 4 of the heat exchanger 1. In this case, the fluid pump 10, which in FIG. 1 is positioned downstream of the component 9 to be cooled, may be operated or may be traversed by flow whilst in a functionless state. If the fluid pump 10 is operated, it assists the flow through the second cooling circuit 13 and also the flow through the heat exchanger 1.

It is likewise possible, in an alternative embodiment, for the fluid pump to also be arranged upstream of the component to be cooled, or for the integration of a fluid pump to be dispensed with entirely.

When the flow through the heat exchanger 1 is greatly reduced or completely shut off by the first cooling circuit, for example as a result of the actuation of a thermostat, at least a major part of the fluid is static within the heat exchanger 1. A circulation of the fluid within the heat exchanger 1 and thus a supply of cooled fluid in the second cooling circuit 13 can then take place either on the basis of the principle of convection or with the aid of the fluid pump 10. The fluid pump 10 then independently delivers fluid through the second cooling circuit 13 and through at least a part of the heat exchanger 1.

Owing to the relatively warm fluid which flows into the heat exchanger 1 through the second fluid inlet 8 after the cooling of the component 9 and owing to the temperature difference that prevails between the fluid from the second cooling circuit 13 and the rest of the fluid in the heat exchanger 1, a flow movement is generated. Said convection flow has the effect that the warmed fluid from the second cooling circuit 13 rises in the heat exchanger 1 and, in the process, mixes with the relatively cold fluid in the heat exchanger 1, resulting in cooling of the fluid.

In the case of a heat exchanger 1 as shown in FIG. 1, the fluid flowing into the lower collecting box 4 of the heat exchanger 1 through a second fluid inlet 8 rises into the upper collecting box 3 through one proportion of the flat tubes 16. There, the fluid distributes over the length of the collecting box 3 and flows into the lower collecting box 4 through another proportion of the flat tubes 16. From there, the fluid, which has now been cooled again, flows through the second fluid outlet 7 into the second cooling circuit 13 again.

In this way, a flow is generated through the heat exchanger 1 owing to the flow through the second cooling circuit 13. The fluid pump 10 can further intensify said flow.

Since the flow generated owing to convection is small, the use of an additional fluid pump 10 is advantageous. The flow through the second cooling circuit 13 can be actively influenced by means of the fluid pump 10.

To prevent a short-circuit flow between the second fluid inlet 8 and the second fluid outlet 7, a flap 12 is provided in the collecting box 4. Said flap is configured such that, in the closed state, it prevents a flow within the collecting box 4 between the second fluid inlet 8 and the second fluid outlet 7. The flap 12 is thus a means for reducing or preventing a fluid flow between the second fluid inlet and the second fluid outlet 8, 7. In the open state, however, the flap 12 does not influence, or has only a slight influence on, the flow within the collecting box 4.

In addition, in the collecting box 4 in FIG. 1, there is provided a partition 11 which extends through the collecting box 4 along the main direction of extent of the flat tubes 16. The partition 11 divides the collecting box 4 into a left-hand region and a right-hand region. The partition 11 constitutes a means for increasing the pressure loss within the collecting box 4.

Said partition 11 serves for increasing the pressure drop between the left-hand part and the right-hand part of the collecting box 4. The partition 11 is advantageously positioned so as to be arranged between the second fluid inlet 8 and the second fluid outlet 7. This is advantageous but not imperative.

If the partition 11 is not arranged between the second fluid inlet 8 and the second fluid outlet 7, it has no influence on the generation of a short-circuit flow. If the partition 11 is arranged between the second fluid inlet 8 and the second fluid outlet 7, the generation of an undesired short-circuit flow between the second fluid inlet 8 and the second fluid outlet 7 is additionally inhibited. The partition 11 inhibits a short-circuit flow in particular when the heat exchanger 1 is traversed by flow from the first cooling circuit in the usual way.

In one advantageous embodiment, the partition 11 is positioned so as to be arranged within the collecting box 4 in a projection of the area of the opening of the fluid outlet 6. Here, said partition may be formed so as to extend into the first fluid outlet 6 or even extend through the first fluid outlet 6 as far as into the coolant line. In alternative embodiments, the partition may also be configured so as not to extend all the way through the collecting box.

In alternative embodiments, the second fluid inlet and the second fluid outlet may also be arranged on one side of the first fluid outlet. It is then likewise the case that a flap must be positioned between the first fluid inlet and the first fluid outlet in order to prevent the generation of a short-circuit flow.

Furthermore, it may likewise be provided that the first fluid outlet and the second fluid outlet are provided in different collecting boxes. It is however advantageous for the second fluid outlet 7 to be arranged on the same collecting box 4 as the first fluid outlet 6. It is ensured in this way that the fluid that flows into the second cooling circuit 13 is at as low a temperature as possible. The fluid that flows out of the heat exchanger 1 through the first fluid outlet 6 has generally passed through the entire cooling path in the block 2 of the heat exchanger 1 and is therefore at a relatively low temperature in relation to the fluid flowing into the heat exchanger.

As a result of the branching-off of the fluid at as low a temperature as possible, the cooling action for the component 9 to be cooled is kept as high as possible.

In alternative embodiments of the invention, it may be provided that the fluid port referred to as second fluid outlet is arranged not in one of the collecting boxes but rather in a coolant line positioned downstream of the first fluid outlet. The second fluid outlet is then formed, in practical terms, by a connection point between the first cooling circuit and the second cooling circuit outside the heat exchanger. The fluid for the second cooling circuit is thus branched off outside the heat exchanger. This is advantageous in particular with regard to the structural configuration of the heat exchanger. Embodiments which have such a configuration are described in the following figures.

Figure 2:
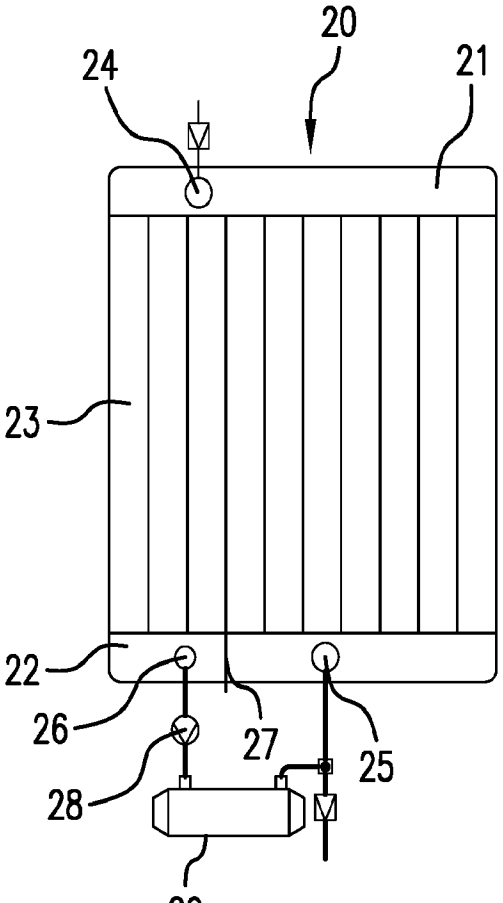
FIG. 2 shows an alternative embodiment of a heat exchanger having one fluid port on one of the collecting boxes and two fluid ports on the respective other collecting box.

FIG. 2 shows an alternative embodiment of a heat exchanger 20. The heat exchanger 20 likewise has two collecting boxes 21, 22 which are in fluid communication with one another through flat tubes 23.

The upper collecting box 21 has a first fluid port 24 through which a fluid can flow into the heat exchanger 20. The fluid can, for this purpose, distribute in the collecting box 21 over the entire width of the heat exchanger 20 and flow along the flat tubes 23 to the lower collecting box 22.

The lower collecting box 22 is divided into a left-hand section and a right-hand section by a partition 27. Here, the partition 27 may permit or prevent a fluid flow between the right-hand section and the left-hand section. The right-hand section has a second fluid port 25 via which the fluid can flow out of the heat exchanger 20. The left-hand section has a third fluid port 26 by which fluid can flow out of or into the heat exchanger 20. Depending on the flow direction, a fluid pump 28 is positioned upstream or downstream of the third fluid port 26. Said fluid pump is part of the second cooling circuit, which furthermore also comprises a component 29 to be cooled.

As already described with regard to FIG. 1, the partition 27 may reduce or entirely prevent a fluid flow between the fluid ports of the respective collecting box. The heat exchanger 20 may in this case be traversed by flow in different ways depending on the temperature distribution that prevails and the pressure differences that prevail.

In an operating situation, flow passes through the heat exchanger 20 from the fluid port 24 along the collecting box 21, and from said collecting box along the flat tubes 23 to the two subsections of the collecting box 22. From there, the fluid flows out of the heat exchanger 20 through the two fluid ports 25, 26. The fluid fraction from the left-hand section flows through the fluid pump 28 and through the component 29 and finally to a connection point in a fluid line in which the fluid fraction from the fluid port 25 of the right-hand section also flows.

A further advantage of an embodiment as per FIG. 1 is that, in the event of a reversal of the delivery direction of the fluid pump 28, the extraction of the fluid for cooling the component 29 may also take place, outside the collecting box, from the first cooling circuit. This may be advantageous for example if the temperature of the fluid at the outlet at the fluid port 25 is more stable. The connection point between the line that is connected to the fluid port 25 and the line that serves for supply to or discharge from the component 29 may in principle be regarded as a further fluid port of the heat exchanger, said further fluid port being situated outside the heat exchanger.

In further embodiments, it may also be advantageous if a third or fourth fluid port is also realized outside the heat exchanger in the manner of the preceding embodiment. In this way, it is also possible for further cooling circuits to be realized, and in this way for the utilized cooler area to be divided up in a more optimized manner depending on the thermal load of the components to be cooled.

Figure 3:
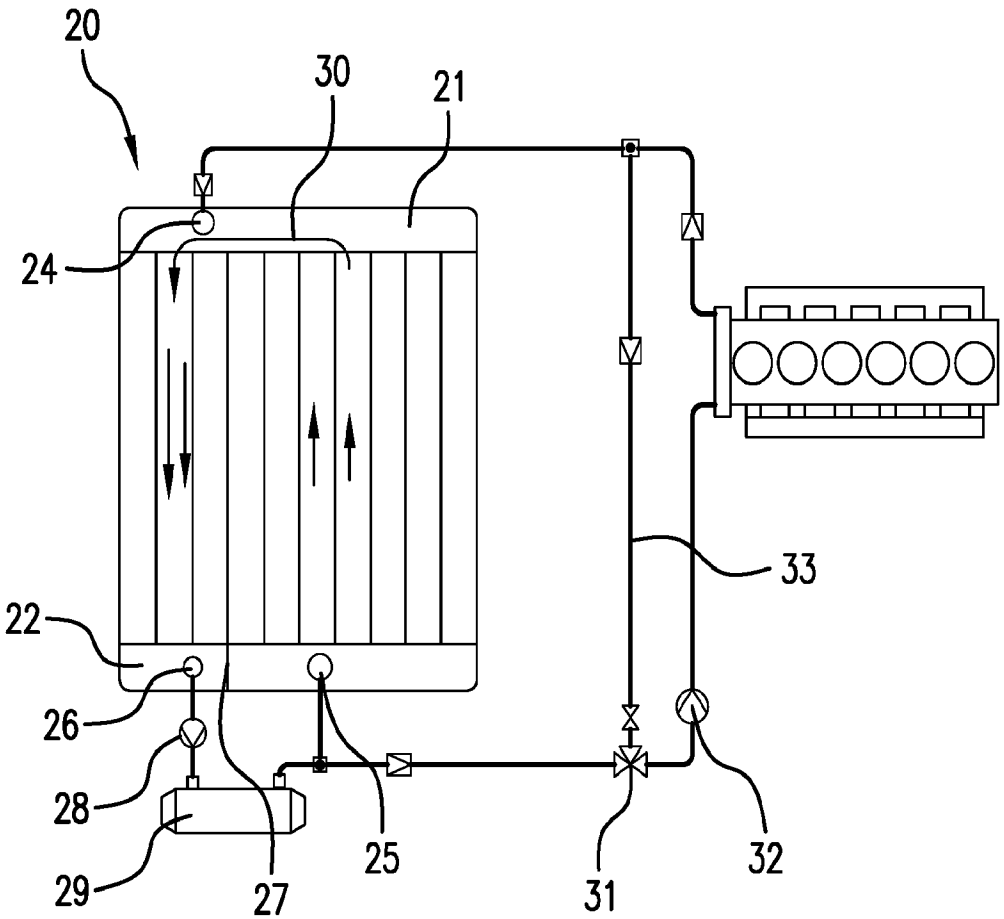
FIG. 3 shows a view of a heat exchanger as per FIG. 2 in an installation situation with an internal combustion engine.

In an alternative embodiment as shown in FIG. 3, it is also possible for a throughflow to be realized on the basis of the following principle. The fluid flows through the fluid port 24 into the collecting box 21 and distributes therein over the entire width of the collecting box 21. Said fluid subsequently flows via the flat tubes 23 into the lower collecting box 22. The fluid fraction from the left-hand section of the collecting box 22 is delivered by the fluid pump 28 through the component 29 and, from there, at least partially through the fluid port 25 into the right-hand section of the collecting box 22. From there, a fraction of the fluid can flow upward through the flat tubes 23 to the collecting box 21, and in the latter along the flow arrow 30 into the left-hand section of the heat exchanger 20.

Such a throughflow is preferable in particular when the fluid flow through the first cooling circuit is stopped or greatly reduced by a blocking valve, for example a thermostat valve. A thermostat valve 31 of said type is illustrated in FIG. 3. Said thermostat valve is arranged upstream of the fluid inlet of an internal combustion engine, as is the case in conventional cooling circuits of internal combustion engines.

Arranged between the thermostat valve 31 and the internal combustion engine is a second fluid pump which serves primarily for the delivery of fluid in the first cooling circuit. The fluid flow into the internal combustion engine and into the bypass duct 33 can be influenced by means of an adjustment of the thermostat valve 31. Here, the bypass duct 33 connects the fluid port 25 to the fluid port 24 of the heat exchanger 20 while bypassing the internal combustion engine.

Figure 4:
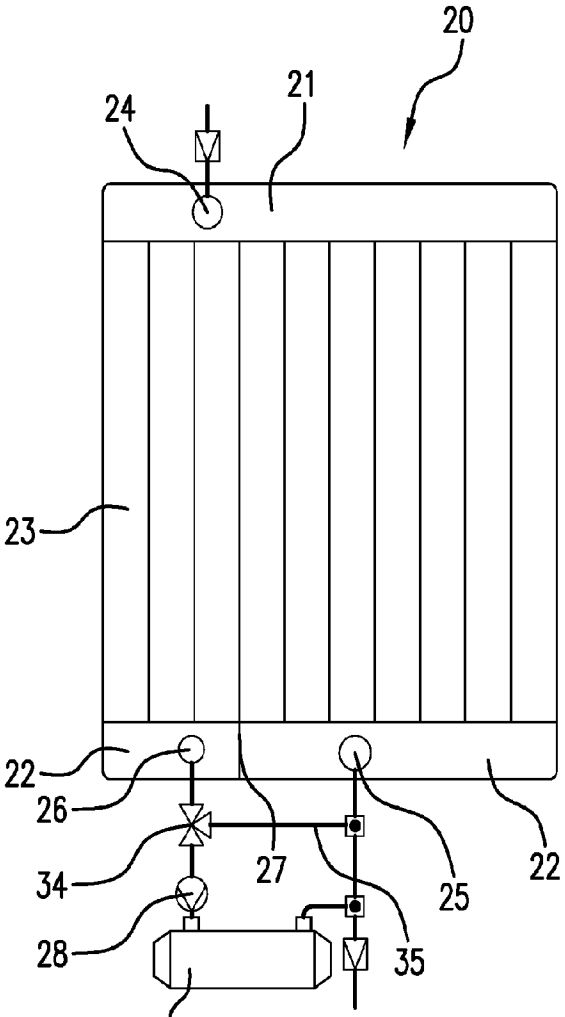
FIG. 4 shows an embodiment of a heat exchanger as per FIGS. 2 and 3, wherein the second cooling circuit has a bypass duct which connects the two fluid ports of the lower collecting box to one another by way of a short circuit.

FIG. 4 shows an alternative embodiment of the heat exchanger 20, wherein by contrast to FIG. 2, there is situated downstream of the fluid port 26 a thermostat valve which regulates the splitting-up of the fluid into the bypass duct 35 and into the fluid pump 28. Depending on the throughflow direction of the second cooling circuit, it is also possible for the bypass duct 35 to be traversed by flow proceeding from the fluid port 25, and for the flow to be split up at the thermostat valve 34 into a flow fraction into the fluid pump 28 and a flow fraction into the fluid port 26 of the heat exchanger 20.

Here, the basic flow through the heat exchanger 20 corresponds to the throughflow principles already described in the preceding figures. Likewise, the partition 27 in the collecting box 22 may be used as already described.

Figure 5:
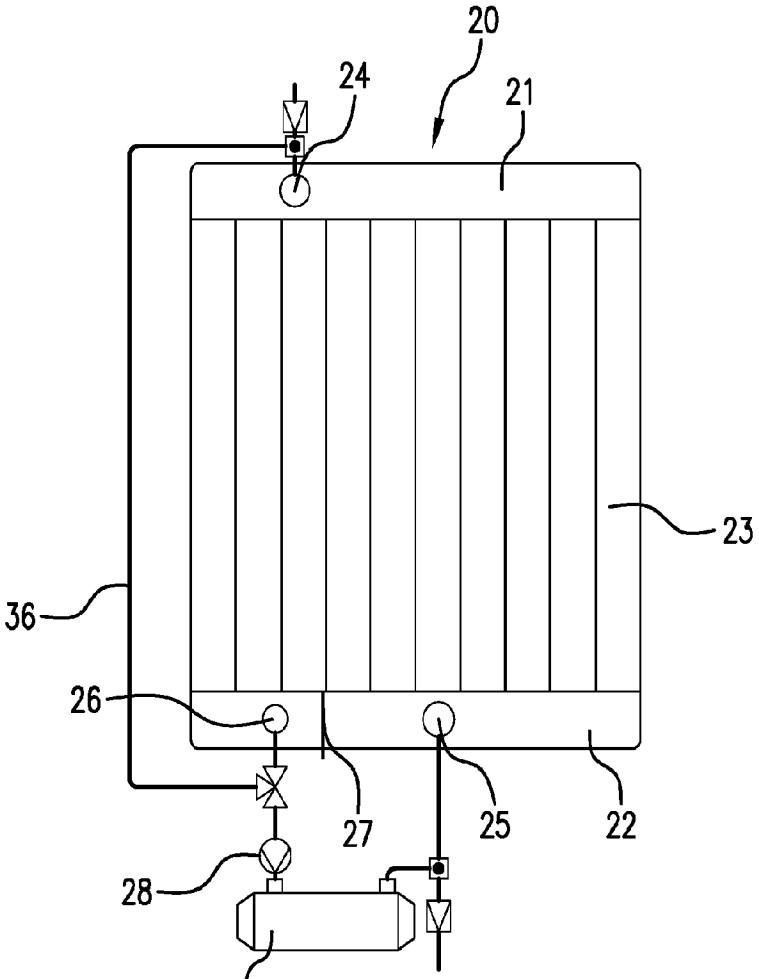
FIG. 5 shows a view of the heat exchanger as per FIG. 4, wherein the bypass duct connects one fluid port of the lower collecting box to the fluid port of the upper collecting box.

FIG. 5 shows a further alternative embodiment of the heat exchanger 20 and of the second cooling circuit. In FIG. 5, it is likewise the case that a thermostat valve 35 is positioned downstream of the fluid port 26. The bypass duct 36 is connected to the supply line to the fluid port 24. By means of such an arrangement, it is possible for the fluid flowing out of the fluid port 26 to be returned to the fluid port 24 through which the fluid flows into the heat exchanger 20.

Alternatively, it is also possible for the fluid, before flowing into the heat exchanger 20 through the fluid port 24, to be conducted through the bypass duct 36 directly through the thermostat valve 34 to the fluid pump 28 and then to the inlet of the component 29. In this way, it is possible to realize a higher temperature of the fluid at the component 29, which may be advantageous in certain operating situations.

Downstream of the component 29, the fluid is conducted, at a connection point, into the fluid line that is in fluid communication with the fluid port 25 of the right-hand section of the collecting box 22. Owing to the pressure loss that arises across the heat exchanger 20, it is for example possible for the pump power of the fluid pump 28 to be reduced.

Figure 6:
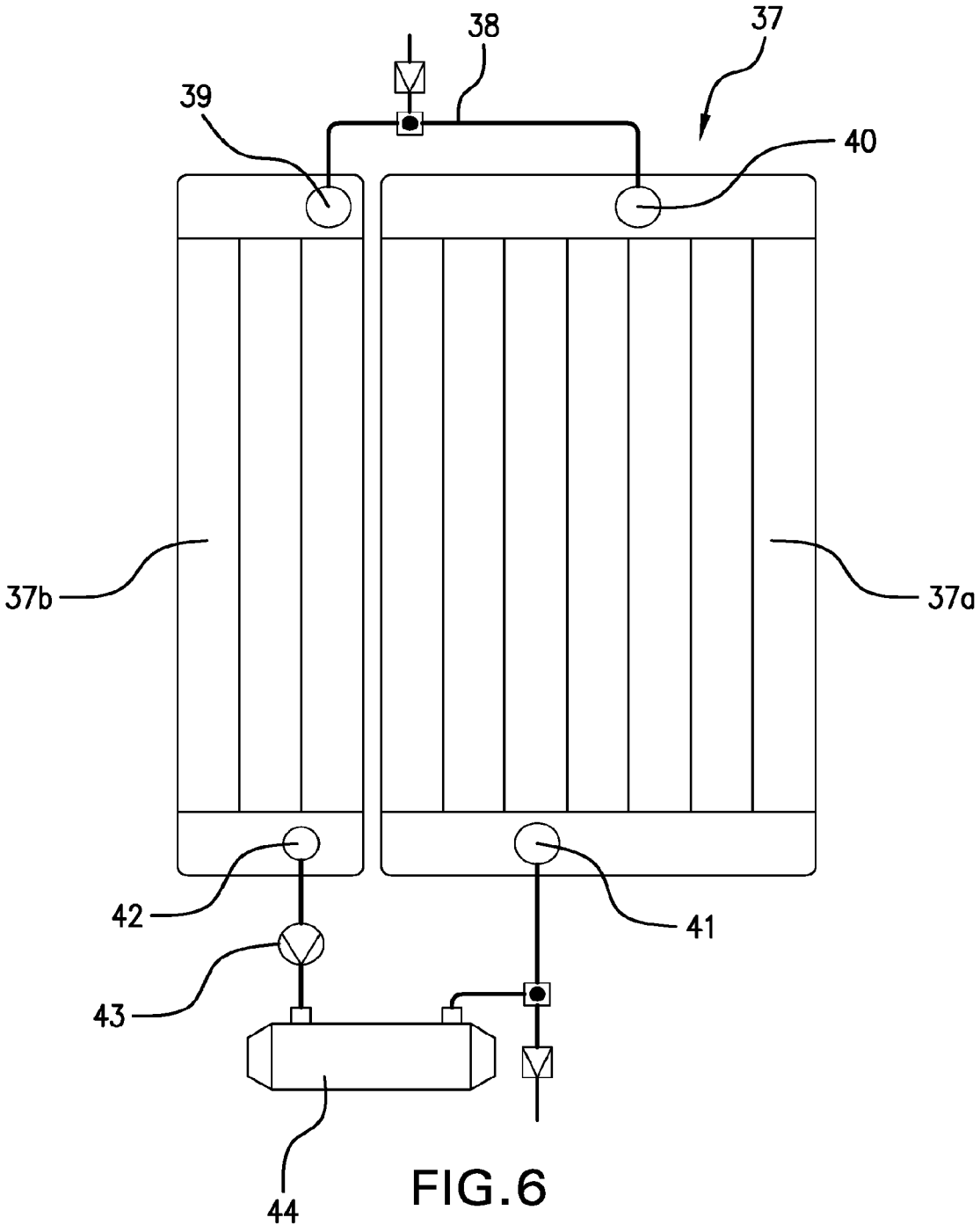
FIG. 6 shows a further alternative embodiment in which the heat exchanger is formed by two individual heat exchangers or two heat exchanger blocks.
Figure 7:
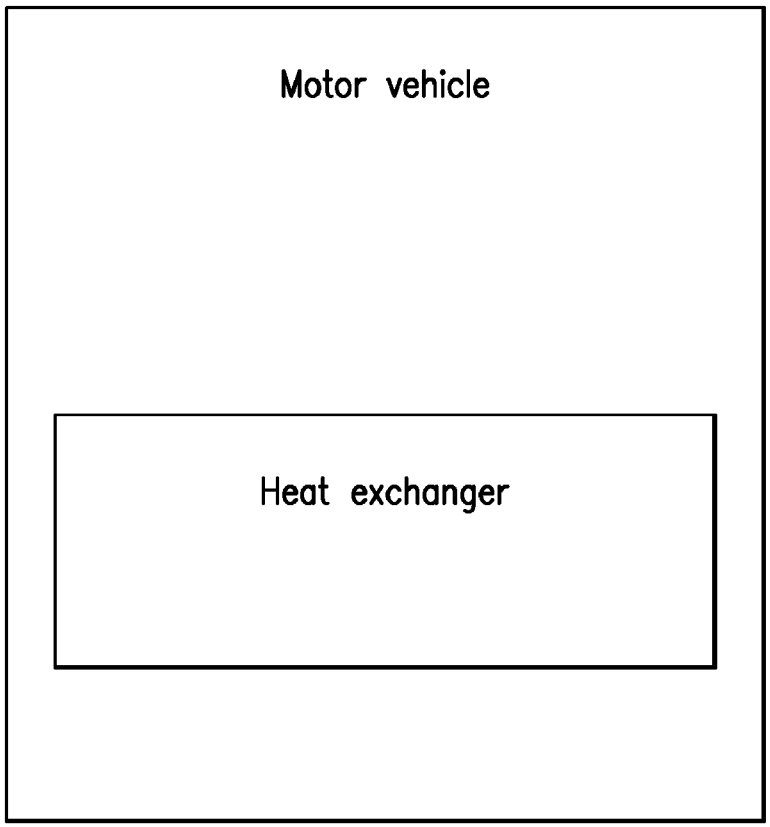
FIG. 7 shows a block diagram depicting a motor vehicle having a heat exchanger according to the present application.

FIG. 6 shows a further alternative exemplary embodiment. The heat exchanger 37 has a first section 37*a* and a second section 37*b*. Said sections may, as shown in FIG. 6, be in the form of separate individual heat exchangers or heat exchanger blocks 37*a*, 37*b* or may be in the form of a unipartite heat exchanger which, in the two collecting boxes, has in each case one partition which divides the respective collecting box into two separate subregions.

Regardless of whether two individual heat exchangers 37*a*, 37*b* are provided or a single heat exchanger is divided by partitions into two separate sections, the two upper collecting boxes and the two lower collecting boxes have in each case one fluid port 39, 40, 41, 42. Via the upper fluid ports 39, 40, a fluid can be supplied into the heat exchanger 37*a*, 37*b* via the T-shaped line 38. The fluid flows into the respective lower collecting boxes along the flat tubes of the heat exchangers 37*a*, 37*b* and flows from there out of the heat exchangers 37*a*, 37*b* via the fluid ports 41, 42.

The fluid flows out of the fluid port 42 through the second cooling circuit into the fluid pump 43 and finally into the component 44, and from there via a connection point into a fluid line which is also in fluid communication with the fluid port 41 of the heat exchanger 37*a*. The heat exchangers 37*a*, 37*b* are in this case impinged on with the same fluid flow, whereas fluid flows at different temperatures are present downstream of the heat exchangers 37*a*, 37*b*.

The individual features of the preceding exemplary embodiments may be combined with one another. The exemplary embodiments have no limiting effect. The exemplary embodiments shown in the figures serve for illustrating the concept of the invention.

The invention claimed is:

1. A heat exchanger for a motor vehicle comprising:

at least one block comprising parallel tubes, wherein fins are arranged between said parallel tubes, wherein the parallel tubes form multiple first flow ducts through which a first fluid can flow, wherein the regions between the parallel tubes form multiple second flow ducts through which a second fluid can flow around the parallel tubes, a first collecting box comprising a first fluid port, a second collecting box comprising a second fluid port and a third fluid port, a first cooling circuit comprising the multiple first flow ducts, the first fluid port, the second fluid port, the first collecting box, and the second collecting box, a second cooling circuit comprising the third fluid port, the second collecting box, at least two of the multiple first flow ducts, and the second fluid port, a fluid which flows through the first cooling circuit and the second cooling circuit wherein the fluid in the first cooling circuit flows in part in a direction from the first fluid port to the second fluid port and the third fluid port;

wherein the fluid in the second cooling circuit flows in part in a direction from the second fluid port to the third fluid port;

wherein the first cooling circuit and the second cooling circuit are joined along the same flow path in at least one of the multiple first flow ducts, wherein second cooling circuit branches off from the first cooling circuit downstream of the heat exchanger and rejoins the first cooling circuit at the third fluid port.

2. The heat exchanger according to claim 1, wherein a plan of the flow ducts or flat tubes refers to a plane encompassing a plurality of central axes of the multiple first flow ducts, wherein the first fluid port, the second fluid port, and the third fluid port are arranged in a direction perpendicular to the plane of the flow ducts or flat tubes.

3. The heat exchanger according to claim 1, wherein second collecting box further comprises a partition, valve, or flap to reduce or prevent a fluid from flowing directly between the second fluid port and the third fluid port.

4. The heat exchanger according to claim 3, wherein, by way of the partition, valve, or flap, the pressure loss in the second collecting box is variable as a function of a pressure difference between the third fluid port and the first fluid port or as a function of the fluid temperature in the second cooling circuit.

5. The heat exchanger according to claim 1, wherein the second cooling circuit is formed between the second fluid port and the third fluid port.

6. The heat exchanger according to claim 1, wherein the heat exchanger is of multi-part construction having multiple subsections, wherein each subsection of the heat exchanger comprises a subsection first collecting box and a subsection second collecting box, wherein each subsection of the heat exchanger has two fluid ports.

7. A motor vehicle comprising a heat exchanger according to claim 1, wherein a component to be cooled is integrated into the second cooling circuit, or a component to be cooled and a fluid pump are integrated into the second cooling circuit.

8. The motor vehicle according to claim 7, wherein, in the second cooling circuit, there is arranged a thermostat valve for regulating or controlling the fluid flow through the component to be cooled.

9. The motor vehicle according to claim 7, wherein the second cooling circuit comprises a bypass duct allowing for fluid communication between the two fluid ports of one collecting box or between in each case one fluid port of the first collecting box and one fluid port of the second collecting box.

10. The motor vehicle according to claim 7, wherein the first cooling circuit is in fluid communication with the second cooling circuit via a connecting point outside the heat exchanger.

* * * * *